United States Patent [19]

Maruyama

[11] Patent Number: 4,788,769

[45] Date of Patent: Dec. 6, 1988

[54] APPARATUS FOR REMOVING EXTRANEOUS MATERIAL FROM CLOTHING

[75] Inventor: Masato Maruyama, Nagano, Japan

[73] Assignee: Seiko Epson Corporation, Tokyo, Japan

[21] Appl. No.: 47,347

[22] Filed: May 8, 1987

[30] Foreign Application Priority Data

May 12, 1986 [JP] Japan ..... 61-70840[U]

[51] Int. Cl.[4] ..... B26B 19/14

[52] U.S. Cl. ..... 30/133; 15/344; 15/347; 15/352

[58] Field of Search ..... 15/344, 347, 352; 30/43.6, 206, 133, 347

[56] References Cited

U.S. PATENT DOCUMENTS

| | | | |
|---|---|---|---|
| 2,802,260 | 8/1957 | Allen | 30/133 X |
| 2,916,821 | 12/1959 | Witmer | 30/133 X |
| 3,872,539 | 3/1975 | Doyel | 15/344 |
| 3,914,820 | 10/1975 | Hankel | 15/344 |
| 4,218,806 | 8/1980 | Cohn | 15/344 X |

*Primary Examiner*—Chris K. Moore

*Attorney, Agent, or Firm*—Blum Kaplan

[57] ABSTRACT

An apparatus for severing pilled material from clothing includes a body and a detachable container. The container is mounted to cover an inner opening of the body and includes protrusions to prevent escape of pilled material therefrom. A fan operably coupled to a shaft of a motor draws the severed pilled material into a body and then through the inner opening which is positioned to face and be laterally spaced from the shaft.

21 Claims, 3 Drawing Sheets

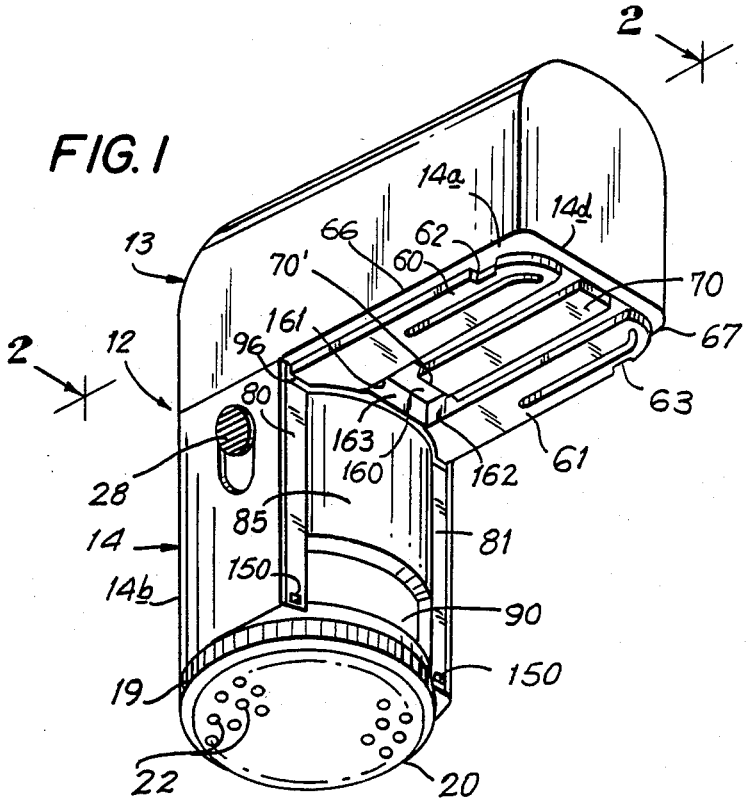
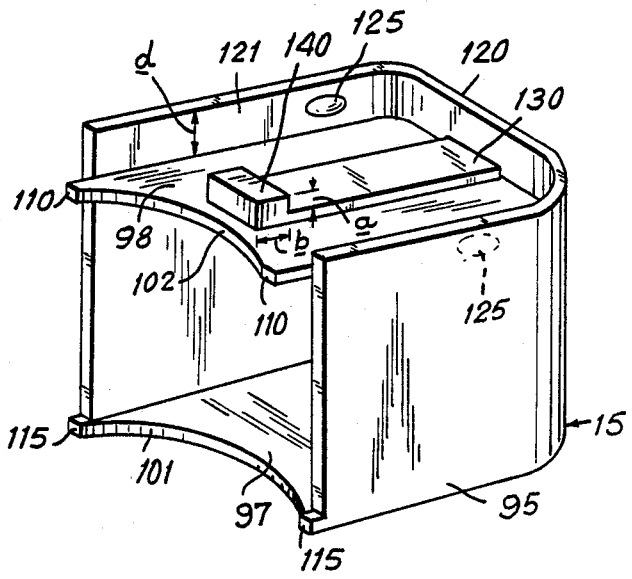
FIG. 3

FIG. 4
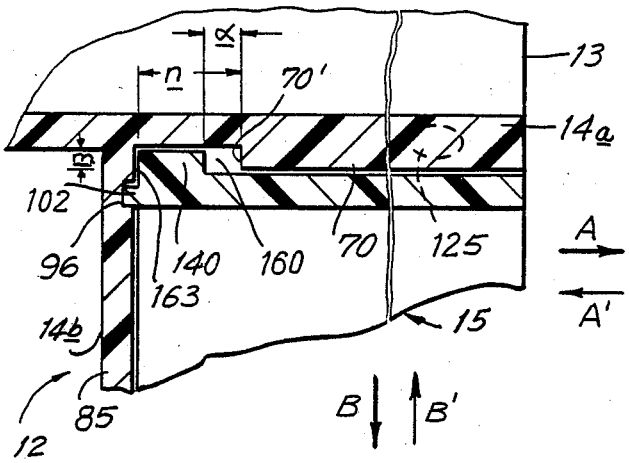
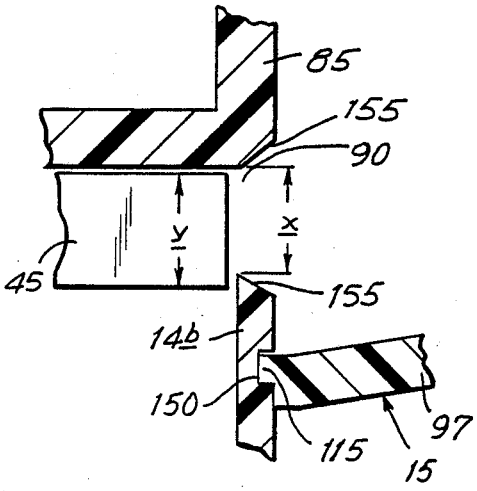
FIG. 5
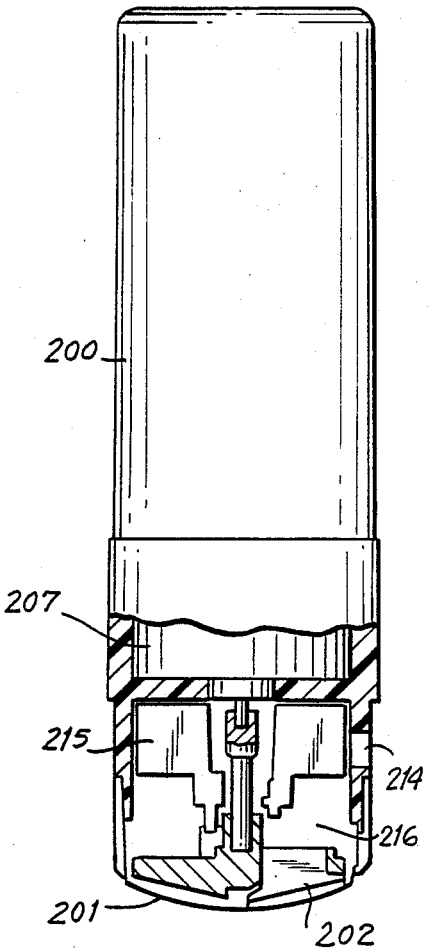
FIG. 6
PRIOR ART

APPARATUS FOR REMOVING EXTRANEOUS MATERIAL FROM CLOTHING

BACKGROUND OF THE INVENTION

This invention relates generally to an apparatus for removing extraneous material from clothing, and especially to electrically operated apparatus for removing fabric or material that has been pilled.

Frequently, clothing made of wool, chemical fibers and other fabrics and/or materials over a period of time becomes matted forming little balls a condition commonly referred to as pilling. In the art, a device depicted in FIG. 6 for removing pilled material from clothing has been provided which is electrically operated and formed with a housing 200 in the shape of a right cylindrical body. This pill removing device includes an outer blade 201 which is mounted on the surface of the housing and an inner blade 202 located within and operably coupled to a motor 207 which is also located within the housing. The inner blade rotatably cooperates with the outer blade to cut pilled material from clothing when the pilled material is pressed against the outer blade. An impeller type fan 215 near and directly above the inner blade and within the housing draws the cut pilled material into the housing. The cut pilled material is then either impelled through a discharge port 214 in the periphery of the housing or pooled within the housing below the inner blade in the region 216 requiring that the apparatus be partially disassembled in order to retrieve the separated pilled material. All other components of the device are either directly above or below the fan in order to accommodate the right cylindrical shape of the housing.

The right cylindrical shape of the pill removing device is uncomfortable to grip since an operator needs to hold the housing near the blades in order to apply sufficient pressure to the device to cut the pilled material. Furthermore, the cylindrical shape results in the operator having to hold the device in a horizontal direction, somewhat like a pen. Therefore, it becomes difficult to both press the device against the clothing and to slide the device past the clothing at the same time.

Pooling of the pill material within the body of the housing severely restricts the amount of material which may be cut before the pilled material needs to be emptied from the body. In an attempt to overcome this space limitation and to avoid having the separated material blown through the discharge port (and, for example, onto the ground thereafter), a dust box has been used to collect the cut pilled material travelling through the discharge port. Unfortunately, due to the cylindrical shape of the device, the dust box and cylindrical housing form a gap therebetween allowing the cut pilled material to escape from the dust box.

SUMMARY OF THE INVENTION

In accordance with the invention, an apparatus includes a housing having an inner opening and a detachable container mounted at the inner opening, the housing and detached container together have a shape resembling a parallelepiped. An inner and outer blade operably cooperate for separating the pilled material from the clothing. The inner blade is operably coupled to a shaft of a motor located within the housing. The axis of rotation of the shaft is laterally spaced from and faced by the inner opening of the housing. The material after being separated by the blades is drawn through the housing by a fan which is also coupled to the shaft. The air currents produced by the fan force the separated material out of the housing through the inner opening and into the detachable container.

Accordingly, it is an object of this invention to provide an improved apparatus for removing extraneous material from clothing which is comfortable to grip and operate.

It is another object of the invention to provide an apparatus for removing extraneous material from clothing which will reduce the frequency at which the separated material must be emptied from the apparatus.

It is yet another object of the invention to prevent the separated material from escaping from the apparatus.

Still other objects and advantages of the invention will in part be obvious and will in part be apparent from the specification.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

BRIEF DESCRIPTION OF THE DRAWINGS

For a fuller understanding of the invention, reference is had to the following description taken in connection with the accompanying drawings, in which:

FIG. 1 is a perspective view of the apparatus in accordance with the invention with the container of FIG. 3 removed;

FIG. 3 is a perspective view of the container;

FIG. 4 is a fragmented cross-sectional view of FIG. 2 centered about a juncture of the housing and container;

FIG. 5 is a fragmented cross-sectional view of FIG. 2 centered about an inner opening of the apparatus; and FIG. 6 is a partially sectional side elevational view of a prior art pill removing device.

DESCRIPTION OF THE PREFERRED EMBODIMENT

Figure 2:
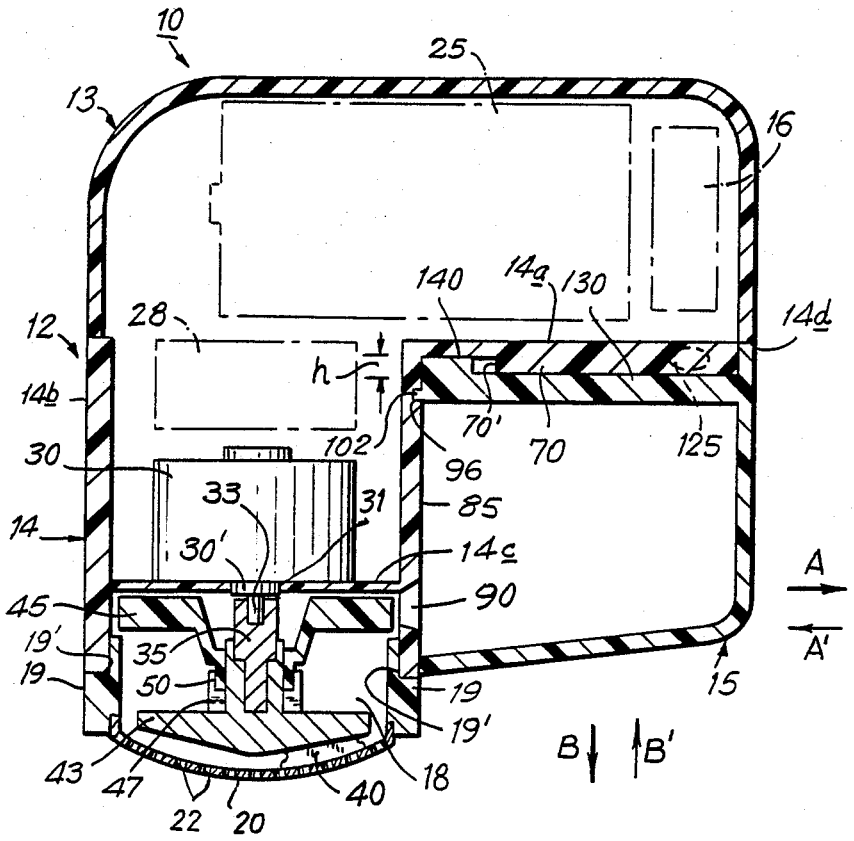
FIG. 2 is a cross-sectional view of a pill removing apparatus taken generally along lines 2—2 of FIG. 1 with the container of FIG. 3 attached to the apparatus.

As shown in FIGS. 1 and 2, an apparatus 10 for removing extraneous material such as, but not limited to, balls of fabric includes a housing 12 and a container 15 which when assembled together resemble a rectangular parallelepiped. Housing 12 has a substantially L-shaped cross-section with a bottom portion 14 (as viewed in FIGS. 1 and 2) and top portion 13. Top portion 13 defines one leg of the L-shaped housing except that it is open on the bottom. Bottom portion 14 defines the other leg of the L-shaped portion an includes a laterally projecting wall **14*a* which closes the otherwise exposed portion of its bottom of the top portion 13. Bottom portion 14 has an essentially U-shaped wall 14*b* joined at its upper periphery to top portion 13 and defining an opening 18 on its other periphery. The legs of U-shaped wall 14*b* are joined by a wall consisting of planar ledges 80 and 81 having a convex portion 85 therebetween. An annular member 19 is supported in the lower periphery of bottom portion 14 at a notched region 19' and supports circular outer blade 20** having a plurality of openings 22 which perform the blade function. Outer blade 20 encloses opening 18 of housing 12.

Within housing 12 is a power supply 25 disposed in top portion 13, a switch 28 (shown schematically) disposed in the upper region of bottom portion 14, a motor 30 mounted on an interior, laterally extending wall 14c of bottom portion 14 and a contact section 16 (shown schematically) disposed in top portion 13 for holding and providing electrical connection between power supply 25, switch 28 and motor 30 (the required leads not being shown). Wall 14c is spaced from opening 18 and defines a partition to keep the cut material from the interior of housing 12. The motor 30 is formed with a mounting member 30' received in a hole 31 in wall 14c. A shaft 33 of motor 30 extends in a direction substantially perpendicular to bottom opening 18 through wall 14c and is connected to a coupler 35. A rotatably inner blade 40 is held by a holder 43, which is in turn mounted on coupler 35, to thereby couple inner blade 40 to shaft 33. A leaf spring (not shown) provides a light resilient force for pressing inner blade 40 against the inner surface of outer blade 20. The hub of a fan 45 is mounted on the hub of holder 43. A claw 50 formed on the hub of fan 45 engages a claw 47 formed on the hub of holder 43 such that the fan 45 is also operably coupled to shaft 33.

Outer blade 20 is made from, but not limited to, and electrocast metal pressed to a thickness of about 100 μm. The plurality of openings 22 are dimensioned to allow pills of material from clothing made of wool or chemical fibers or the like to pass therethrough. Contact section 16 can comprise, for example, hard wire through which motor 30 is electrically energized by power supply 25. Power supply 25 is disposed substantially perpendicular to shaft 33 so as to accommodate the desired compactness of apparatus 10.

Motor 30 is secured within housing 12 by any suitable means such as, but not limited to, screws or by ribs (not shown) of housing 12 in a sandwich-like fashion. Power source 25 can comprise one or more batteries which are accessible through a cover (not shown) detachable from the wall of top portion 13. For example, such a battery cover could be fixed to housing top portion 13 by engagement of a protrusion extending from the battery cover to a claw mounted on the interior surface of housing 13 and also including resin springs for closing.

Along the outer (lower) surface of wall 14a are two ledges 60 and 61 having indentations 62 and 63, respectively. Ledges 61 and 62 run along the length of side wall 14a and are spaced somewhat inwardly from a pair of edges 66 and 67 of wall 14a. As ledges 60 and 61 approach an end 14d of wall 14a they curve inwardly toward each other. A rectangular block 70 protrudes from and is integrally connected to the outer surface of wall 14a and is positioned between ledges 60 and 61. Block 70 extends from near end 14d of wall 14a and terminates at a point 70' spaced from convex wall portion 85. A recess 160 is formed by an inner side 161 of ledge 60, an inner side 162 of ledge 61, the end 70' of block 70 and a surface 163. The depth and width of recess 160 are denoted by m and n, respectively (shown in FIG. 4). An inner opening 90 of housing 12 extends through wall 85 between ledges 80 and 81 and is at a laterally spaced position relative to the axial direction of shaft 33 in the region between lateral wall 14c and opening 18. A groove 96 runs along wall 85 between ledges 80 and 81 and into said ledges at a position near wall 14a but does not extend to the outer surface of housing 12. Ledges 80 and 81 also include recesses 150 near the bottom end thereof (FIGS. 1 and 5).

Referring now to FIG. 3, container 15 resembles a substantially open ended box having a side wall 95 which has a substantially U-shaped cross-section. A bottom wall 97 and a top wall 98 have curved edges 101 and 102, respectively, at the open end. Bottom wall 97 mates with the lower periphery of side wall 95 while top wall 98 is spaced the distance d below its upper periphery of side wall 95. Curved edge 102 of wall 98 protrudes beyond side wall 95 is curved to substantially conform to groove 96 and has flat sides 110. Similarly, curved portion 101 of bottom wall 97 has flat protruding ends 115 which are in registration with side wall 95 and a central curved portion sloped to substantially conform to convex wall 85. The distance d is slightly greater than the height h of block 70 (shown in FIG. 2) for reasons which will be appreciated hereinafter. On an interior surface 121 of side wall 95 between top wall 98 and edge 120 are clock mechanisms 125. A rectangular block 130 is integrally connected to the outer (upper) surface of top wall 98. Block 130 has a box-like protrusion 140 at one end thereof near edge 102 of top wall 98. Protrusion 140 has a height a substantially equal to depth m and a width b less than length n of gap 160 for reasons as will be also appreciated hereinafter.

Referring now to FIG. 4, container 15 is attached to housing 12 as follows. Initially, container 15 is moved in a direction B' such that protrusion 140 is inserted into gap 160. Container 15 is then slid in direction A' such that curved edge 102 slides into groove 96 and click mechanism 125 slidably engage indentations 62 and 63, thereby securing container 15 to housing 12. Container 15 can be removed from housing 12 in order to empty the contents of the separated pilled materials by first sliding container 15 in a direction A by a distance $\alpha$ until protrusion 140 contacts block 70. Block 70 thus serves as a stop mechanism for container 15. Upon protrusion 140 contacting block 70, container 15 is moved in direction B and is thereby freed from housing 12 for emptying the contents of container 15.

Ledges 60 and 61 serve as both guides for attaching and detaching container 15 to housing 12. More specifically, during attachment of container 15 to housing 12 or detachment therefrom any lateral movement of container 15 relative to housing 12 is substantially avoided since peripheral edge 120 of container 15 will slidably abut ledges 60 and/or 61.

Referring once again to FIG. 2, operation of apparatus 10 is as follows. Switch 28 is switched to energize motor 30 which is powered by source 25 thereby causing shaft 33 to rotate. Consequently, inner blade 40 will rotate against the interior surface of outer blade 20 cutting any pilled material which extends through one or more openings 22 of outer blade 20. Fan 45, which has impeller type blades, draws the separated, pilled material into housing 12 and toward fan 45. Once within the housing and near fan 45 the pilled material has a tendency to scatter outwardly due to the centrifugal force applied by fan 15 resulting in the pilled material travelling through opening 90 and accumulating within container 15.

As shown in FIGS. 2 and 5, when container 15 is connected to apparatus 12 protrusions 115 of container 15 are received by recesses 150 of housing 12. The protrusions 115 and recesses 150 serve to fill any gap existing between bottom wall 97 and ledges 80 and 81. By filling this gap the pilled materials are prevented from escaping from container 15. Protrusions 115 and recesses 150, when placed together also serve to prevent lateral and vertical movement of container 15 relative to housing 12.

As shown in FIG. 5, opening 90 has chamfered edges 155 which slope outwardly from opening 90 toward container 15. Consequently, the discharge efficiency of the pilled material from housing 12 to container 15 is increased. Furthermore, in order to prevent the separated pilled material from becoming entangled between fan 45 and opening 90, the height y of each blade of fan 45 is dimensioned to be greater than the width x of opening 90 nearest fan 45.

Apparatus 10 has the following dimensions: overall length 86 mm, overall width 76 mm and overall depth 39 mm. Container 15 is approximately 43 mm×42 mm×39 mm. Power supply 25 is approximately 50 mm×25 mm. Fan 45 is approximately 32 mm×7 mm. Opening 90 has width x of approximately 10 mm to 20 mm. Each impeller blade of fan 45 has a height y slightly greater than width x by an additional length of 0.5 to 5 mm. Due to the compact size of apparatus 10, power source 25 has nominally low ratings of approximately 1.0 to 1.5 volts and approximately 450 ma to 800 ma. Consequently, motor 7 has a very low rotary torque. Therefore, fan 45 does not create a great deal of suction to vigorously draw the separated pill material through opening 90. Bottom wall 97 of container 15 is therefore dimensioned to be sufficiently below opening 90 when container 15 is mounted to housing 12 to allow the separated pilled material when entering container 15 to fall down to bottom wall 97 (FIGS. 2 and 5). Accordingly, an increase in discharge efficiency is obtained and a reverse flow of pilled material through opening 90 which might otherwise occur due to the pilled material aggregating at opening 90 is prevented.

As can now be readily appreciated, the invention provides an apparatus which is easier to grip. The invention is also more comfortable to use since an operator can hold apparatus 10 from its upper end near power source 25 while applying both downward pressure from the palm of the operator's hand to pick up the pilled material and horizontal pressure to slide apparatus 25 along the clothing. Consequently, housing 12 need not be necessarily limited to an essentially L-shaped body. Rather, the shape of housing 12 and especially the top portion can be modified to form a number of different shapes such as, but not limited to, a ball-like top portion. The essential requirement is that the top portion of the housing (the side opposite to outer blade 20) fit within the palm of the operator's hand in order to obtain the benefits of the invention. Furthermore, by providing container 15, there is no longer a practical limitation on the amount of pilled material which can be picked up due to the volumetric space within housing 12. Still further, protrusions 115 of container 15 in cooperation with recesses 150 of ledges 80 and 81 prevent any pilled material from escaping from container due to any gap which may exist between container 15 and housing 12.

It will thus be seen that the objects set forth above, and those made apparent from the preceding description, are efficiently obtained and, since certain changes may be made in the above construction without departing from the spirit and scope of the invention, it is intended that all matter contained in the above description or shown in the accompanying drawings shall be interpreted as illustrative and not in a limiting sense. It is also to be understood that the following claims are intended to cover all the generic and specific features of the invention herein described, and all statements of the scope of the invention which, as a matter of language, might be said to fall therebetween.

What is claimed is:

1. An apparatus for removing extraneous material from clothing comprising:

a housing having an inner opening and an exterior surface, said inner opening leading to the exterior surface;

drive means mounted within the housing and having a rotatable shaft, the axis of rotation of said shaft being laterally spaced from and substantially parallel to said opening;

an inner blade operably coupled to the shaft and an outer blade mounted on the housing, said blades operable for separating the extraneous material from the clothing;

fan means within the housing for drawing the separated material into the housing and forcing the separated material through the opening; and a container detachably mounted to the exterior surface of the housing and which covers the inner opening for receiving the separated material.

2. The apparatus of claim 1, and including means for preventing the separated material from escaping between the housing and the container.

3. The apparatus of claim 2, wherein the means for preventing comprise a plurality of protrusions connected to the container and a corresponding plurality of recesses on the outer surface of the housing for receiving the protrusions.

4. The apparatus of claim 1, wherein the periphery of the inner opening is chamfered outwardly.

5. The apparatus of claim 1, wherein the fan means comprise blades whose height in the direction of the axis of rotation of said shaft is greater than the width of the inner opening nearest the fan means.

6. The apparatus of claim 1, wherein the container comprises side, bottom and top walls; and wherein the container when mounted on the housing has its bottom wall below the inner opening.

7. The apparatus of claim 1, wherein the outer surface of the housing is essentially L-shaped.

8. The apparatus of claim 7, wherein the outer surface of the apparatus with the container mounted to the housing essentially forms a rectangular parallelepiped.

9. The apparatus of claim 7, wherein the outer blade is mounted at the end of one leg of said L-shaped housing, said opening being on a side of said one leg facing in the direction of the other leg.

10. An apparatus for removing extraneous material from clothing comprising:

a housing having an essentially L-shaped outer surface and an inner opening which is located on a side of one leg of said L-shaped housing in the direction of the other leg;

drive means mounted within the housing and having a rotatable shaft, the axis of rotation of said shaft being laterally spaced from and faced by said opening;

an inner blade operably coupled to the shaft and an outer blade mounted at the end of said one leg of the L-shaped housing, said blades operable for separating the extraneous material from the clothing;

fan means within the housing for drawing the separated material into the housing and forcing the separated material through the opening; and a container detachably mounted on the housing and which covers the inner opening for receiving the separated material wherein said container is mounted in the space defined between the legs of said L-shaped housing.

11. The apparatus of claim 9, wherein said housing includes a laterally extending wall in said one leg thereof positioned so that said blades, fan means and opening are on one side and said drive means are on the other side thereof, said laterally extending wall including an aperture for the passage of said shaft therethrough but preventing the passage of separated material.

12. The apparatus of claim 11, wherein the drive means includes motor means having said shaft, power means and switch means in said housing, said switch means including a manual activator operable from outside of said housing.

13. The apparatus of claim 12, wherein the power means includes a battery.

14. The apparatus of claim 1, wherein said fan means is operably coupled to the shaft.

15. The apparatus of claim 1, wherein the housing comprises stop means operable for controlling the movement of the container in a direction perpendicular to the axis of the rotable shaft when detaching the container from the housing.

16. An essentially rectangular parallelepiped apparatus for removing extraneous material from clothing comprising:

an essentially L-shaped housing having an exterior surface and an inner opening whose periphery is chamfered outwardly and which leads to the exterior surface;

drive means mounted within the housing and having a rotatable shaft having an axis of rotation laterally spaced from and substantially parallel to said opening;

an inner blade operably coupled to the shaft and an outer blade mounted on the housing, said blades operable for separating the extraneous material from the clothing;

fan means within the housing operably coupled to the shaft for drawing the separated material into the housing and including blades whose height is greater than the width of the inner opening nearest the fan means;

a container detachably mounted to the exterior surface of the housing and which covers the inner opening for receiving the separated material; and means for preventing the separated material from escaping between the housing and the container and including a plurality of protrusions connected to the container and a corresponding plurality of cavities on the outer surface of the housing for receiving the protrusions.

17. The apparatus of claim 16, wherein the outer blade is mounted at the end of one leg of said L-shaped housing, said opening being on a side of said one leg facing in the direction of the other leg.

18. An essentially rectangular parallelepiped apparatus for removing extraneous material from clothing comprising:

an essentially L-shaped housing having an inner opening whose periphery is chamfered outwardly;

drive means mounted within the housing and having a rotatable shaft having an axis of rotation laterally spaced from and faced by said opening;

an inner blade operably coupled to the shaft and an outer blade mounted on the housing, said blades operable for separating the extraneous material from the clothing;

fan means within the housing operably coupled to the shaft for drawing the separated material into the housing and including blades whose height is greater than the width of the inner opening nearest the fan means;

a container detachably mounted on the housing and which covers the inner opening for receiving the separated material wherein said container is mounted in the space defined between the legs of said L-shaped housing; and means for preventing the separated material from escaping between the housing and the container and including a plurality of protrusions connected to the container and a corresponding plurality of cavities on the outer surface of the housing for receiving the protrusions.

19. The apparatus of claim 16, wherein said housing includes a laterally extending wall in said one leg thereof positioned so that said blades, fan means and opening are on one side and said drive means are on the other side thereof, said laterally extending wall including an aperture for the passage of said shaft therethrough but preventing the passage of separated material.

20. The apparatus of claim 19, wherein the drive means includes motor means having said shaft, power means and switch means in said housing, said switch means including a manual activator operable from outside of said housing.

21. The apparatus of claim 20, wherein the power means includes a battery.

* * * * *